US006856233B2

(12) United States Patent
Tsukada et al.

(10) Patent No.: US 6,856,233 B2
(45) Date of Patent: Feb. 15, 2005

(54) CHIP RESISTOR

(75) Inventors: Torayuki Tsukada, Kyoto (JP); Mitsuo Nonaka, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 0 days.

(21) Appl. No.: 10/093,374

(22) Filed: Mar. 11, 2002

(65) Prior Publication Data

US 2002/0125985 A1 Sep. 12, 2002

(30) Foreign Application Priority Data

Mar. 9, 2001 (JP) ..... 2001-067409

(51) Int. Cl.[7] ..... H01C 1/00
(52) U.S. Cl. ..... 338/195; 338/309
(58) Field of Search ..... 338/195, 307, 338/309

(56) References Cited

U.S. PATENT DOCUMENTS 2,382,024 A * 8/1945 Priessman ..... 338/195
3,477,055 A * 11/1969 Herbst et al. ..... 338/22 R
3,916,366 A * 10/1975 Jefferson ..... 338/21
4,200,970 A * 5/1980 Schonberger ..... 29/593
4,434,416 A * 2/1984 Schonberger ..... 338/22 R
5,164,698 A * 11/1992 Palanisamy ..... 338/307
5,351,390 A * 10/1994 Yamada et al. ..... 29/612
5,798,685 A * 8/1998 Katsuki et al. ..... 338/195
6,297,556 B1 * 10/2001 Heger et al. ..... 257/766
6,304,167 B1 * 10/2001 Nakayama ..... 338/195
6,314,637 B1 * 11/2001 Kimura et al. ..... 29/620
6,356,184 B1 * 3/2002 Doi et al. ..... 338/309
6,401,329 B1 * 6/2002 Smejkal et al. ..... 29/619

FOREIGN PATENT DOCUMENTS

JP 5-217712 * 8/1993
JP 6-196307 * 6/1994 ..... 338/22 SD
JP 2001-44006 * 2/2001

OTHER PUBLICATIONS

Partial machine translation of Nobuyoshi 05–217712 (Aug. 1993).*

* cited by examiner

*Primary Examiner*—Karl D. Easthom
(74) *Attorney, Agent, or Firm*—Sughrue Mion, PLLC

(57) ABSTRACT

A chip resistor having a highly accurately adjusted low resistance value is obtained. The chip resistor having a vertically three-layered structure is obtained by forming a first electrode 1A by printing paste for an electrode on an insulating substrate 5 and drying it, a resistor layer 3 by printing paste for a resistor on the first electrode 1A and drying it, a second electrode 1B by printing paste for an electrode on the resistor layer 3 and the insulating substrate 5 and baking it. Trimming is applied to the thus fabricated chip resistor so as to adjust a resistance value to a given value.

11 Claims, 3 Drawing Sheets

CHIP RESISTOR

FIELD OF THE INVENTION

The invention relates to a chip resistor having a low resistance, particularly to a chip resistor having a resistance value which is adjusted to a low resistance value.

BACKGROUND OF THE INVENTION

A chip resistor has been widely used for a resistor in view of high density, downsizing and the like of a circuit as an IT (information technology) associated equipment and the like have become recently widespread. A conventional chip resistor comprises, as illustrated in FIG. 6 showing a plan view and FIG. 7 showing a side view, a pair of first electrodes 1 formed by printing a conductive paste comprised of precious metals such as Au, Ag or Au—Pt or comprised of Cu, Al or Ni based material on an insulating substrate 5 (hereinafter referred to as simply substrate 5) made of a material such as alumina, steatite, forsterite and the like by screen printing and the like, and baking the printed conductive paste, and a resistor pattern formed by printing paste for a resistor comprised of a Pd—Ag based or Pd—Ag—$RuO_2$ based material and the like on the thus formed pair of electrodes 1 and baking the printed paste for a resistor so as to extend over the pair of electrodes absorption-type polarizing film 1. Further, an overcoat for protecting the resistor and a side electrode are provided, if necessary.

Since a resistance value of the thus fabricated chip resistor 10 is determined by a sectional area of a resistor film or layer 3 between the pair of electrodes, i.e. the product of a width Y and a thickness Z of the resistor layer 3, i.e. Y×Z and a length X thereof between the pair of electrodes, it is adjusted by reducing a sectional area S1 of the resistor layer 3 so as to obtain a given value in the manner of normally cutting away a part T1 of the resistor layer 3 by computer-controlled laser and the like as shown in FIG. 8.

With the conventional chip resistor 10 having the foregoing construction, the resistor layer 3 is disposed over the pair of electrodes 1 so as to connect therebetween, and the sectional area S1 of the resistor layer 3 between the pair of electrodes 1 taken along a line in parallel with both electrodes is small, and the length X of the resistor layer 3 between the pair of electrodes 1 is longer compared with the thickness thereof. Further, since the entire size of the resistor layer 3 is very small to an extent of about 0.3×0.6 mm, it is convenient for the chip resistor 10 to obtain a high resistance value but it is not easy for the chip resistor 10 to obtain a low resistance value.

Still further, in the case of adjusting a resistance value, trimming is applied to the resistor layer in a linear shape or hooked shape as viewed from a plane thereof shown in FIG. 8 so that the resistance value is controlled by mainly controlling the sectional area S1 (FIG. 8). However, since the sectional area S1 is small, there is a limit to apply trimming to the resistor layer as a matter of course so as to adjust the resistance value, an hence since an adjustable range of the resistance value is small, a given resistance value is not easily obtained.

SUMMARY OF THE INVENTION

It is a first object of the invention to provide a chip resistor capable of obtaining a low resistance value compared with a conventional chip resistor, e.g. a resistance value of about 1 Ω to 1 K Ω, and also capable of adjusting a resistance value by trimming a resistor layer with high accuracy compared with the conventional chip resistor by increasing a sectional area of the resistor layer.

It is another object of the invention to provide a chip resistor to which a novel trimming method is applied for adjusting the resistance value.

It is still another object of the invention to provide a chip resistor capable of reducing noises by increasing a sectional area of a resistor layer between both electrodes taken along a line in parallel with both electrodes, and of rendering an overvoltage breakage caused by concentration of a current to hardly occur by reducing the distance between the electrodes to a large extent compared with the conventional chip resistor.

The chip resistor of a first aspect of the invention is characterized in comprising a first electrode formed on an substrate, a resistor layer formed on the first electrode, a second electrode formed on the resistor layer and the substrate, and resistance value adjusting means.

The chip resistor of a second aspect of the invention is characterized in that the resistance value adjusting means comprises a trimming section formed on the resistor layer by trimming the resistor layer through the second electrode.

The chip resistor of a third aspect of the invention is characterized in that the resistance value adjusting means comprises a first trimming section formed on the resistor layer by trimming the resistor layer through the second electrode, and a second trimming section formed on the resistor layer by trimming the resistor layer at an exposed portion corresponding to and through a cut portion of the second electrode.

The objects of the invention can be achieved by carrying out a method of fabricating the chip resistor set forth hereunder.

The method comprises forming the first electrode by printing a material for an electrode on the substrate and baking it, forming the resistor layer by printing a material for a resistor on the first electrode, and baking it, forming a second electrode by printing the material for an electrode on the resistor layer and the substrate, thereby fabricating the chip resistor, said method further including the step of applying trimming to the thus fabricated chip resistor to adjust a resistance value, this step comprising a first trimming step for trimming the resistor layer through the second electrode, and a second trimming step for trimming the resistor layer at an exposed portion corresponding to and through a cut portion of the second electrode upon completion of the first trimming step.

PREFERRED EMBODIMENT OF THE INVENTION

Figure 1:
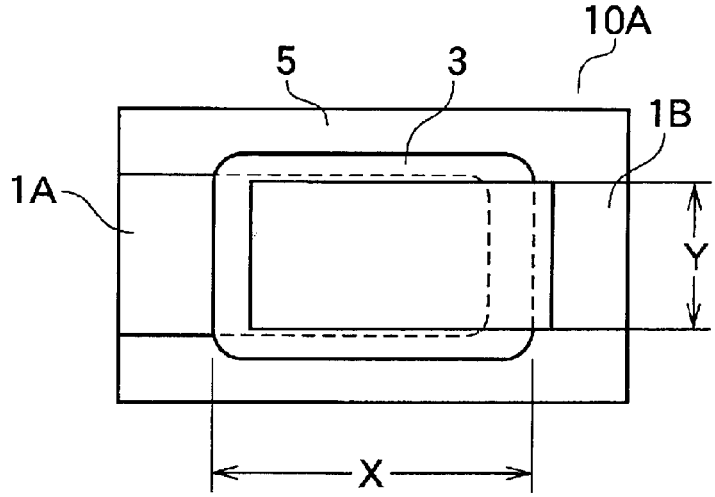
FIG. 1 is a plan view for explaining the construction of a chip resistor according to a preferred embodiment of the invention.

FIG. 1 is a view for explaining the construction of a chip resistor 10A according to a preferred embodiment of the invention.

The chip resistor 10A comprises a first electrode 1A made of gold or silver paste and formed on a substrate 5 made of, e.g. alumina in the same manner as the conventional chip resistor, a resistor layer 3 provided on the first electrode 1A, and a second electrode 1B provided on both the resistor layer 3 and substrate 5.

That is, the chip resistor 10A has a three-layered structure wherein the first electrode 1A and second electrode 1B are disposed on the substrate 5 while sandwiching the resistor layer 3 therebetween.

Figure 3:
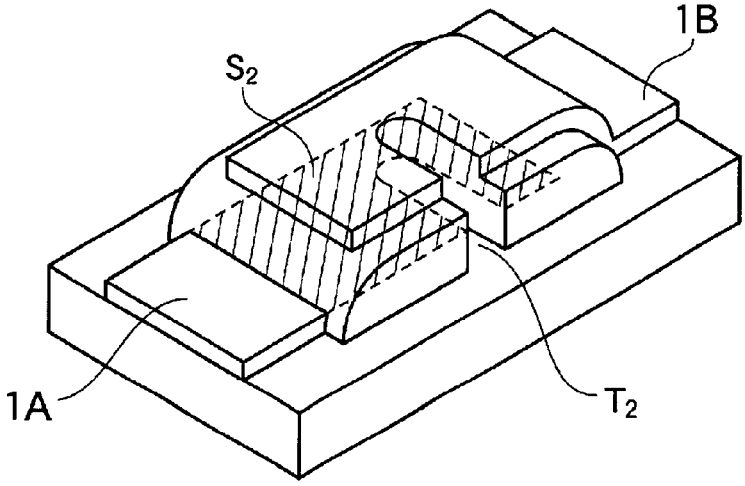
FIG. 3 is a perspective view showing a trimming state of the chip resistor.
Figure 6:
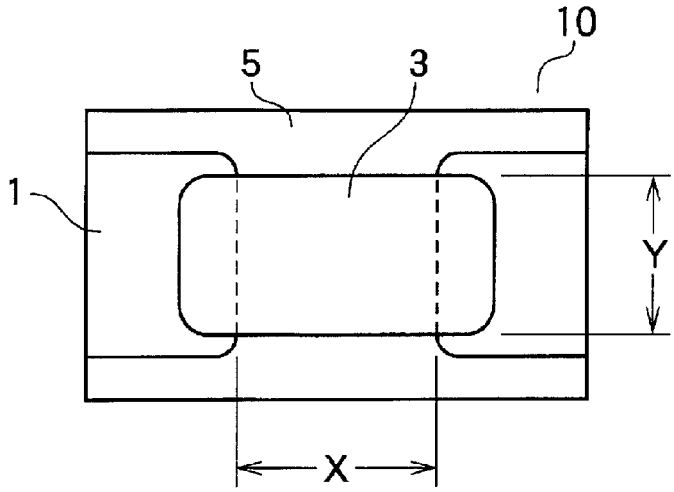
FIG.6 PRIOR ART
FIG. 6 is a plan view showing the construction of a conventional chip resistor.
Figure 7:
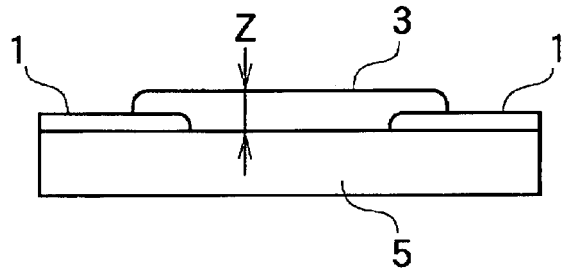
FIG.7 PRIOR ART
FIG. 7 is a side view of the chip resistor in FIG. 6.
Figure 8:
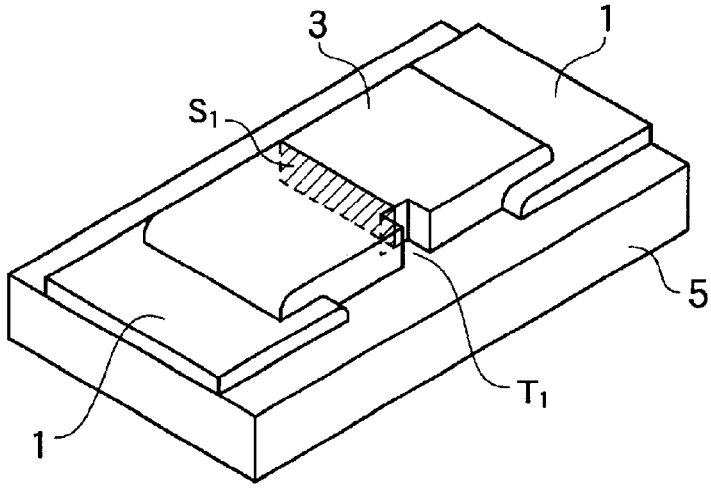
FIG.8 PRIOR ART
FIG. 8 is a perspective view showing a trimming state of the conventional chip resistor.

Since an effective sectional area S2 of the resistor layer 3 between the first electrode 1A and second electrode 1B of the chip resistor 10A taken along a line in parallel with the first electrode 1A and second electrode 1B has a laminated structure in which the first electrode 1A and the second electrode 1B shown in FIG. 3 sandwich the resistor layer 3, it is increased to a large extent compared with the sectional area S1 of the resistor layer 3 of the conventional chip resistor, wherein paste for a resistor is merely overlaid on and disposed between the electrodes 1A as shown in FIG. 6 to FIG. 8. Meanwhile, although the effective sectional area S2 is not a mere product of X×Y wherein X is a length of the superimposed first electrode and second electrode 1B which sandwich the resistor layer 3 therebetween and Y is a width of the upper side second electrode 1B which is narrower than the width of the lower side first electrode 1A, namely, the effective sectional area S2 is not mere the product of X×Y in terms of accuracy and because of the presence of the exposed portion of the resistor layer but it substantially corresponds to the product of X×Y.

Further, since a distance Z between the first electrode 1A and second electrode 1B is substantially the same as a thickness of the resistor layer 3, the distance Z is reduced to a large extent compared with the conventional chip resistor (X shown in FIG. 6), so that the chip resistor can obtain a lower resistance value compared with the conventional chip resistor.

Both the first electrode 1A and second electrode 1B have free sizes unless they don't touch each other while sandwiching the resistor layer 3 therebetween, and they have also free shapes, namely, they are not limited to the shapes positioned in parallel with each other, in other words, the shapes thereof can be freely selected.

A method of fabricating the chip resistor of the invention is described next.

Figure 2:
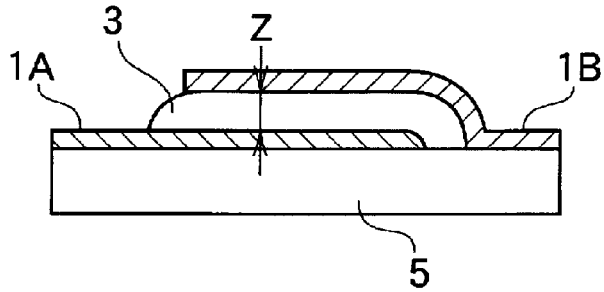
FIG. 2 is sectional view of the chip resistor in FIG. 1.

The method of fabricating the chip resistor comprises preparing the substrate 5 made of e.g. alumina ceramic, printing paste for an electrode comprised of a conductive paste on the substrate 5 by a thick film printing, screen printing, and the like to form an electrode pattern, drying the electrode pattern to form the first electrode 1A. The method subsequently comprises printing paste for a resistor on the thus formed first electrode 1A by a screen printing, a thick film printing, and the like in the same manner as the conventional chip resistor, drying (baking, if necessary) the printed paste for a resistor to form the resistor layer 3. The method further comprises printing paste for an electrode on the resistor layer and baking the paste for an electrode to form the second electrode 1B, thereby forming the chip resistor 10A having the three-layered structure as shown in FIG. 2.

The resistance value of thus fabricated each chip resistor 10A is adjusted to a given value by cutting away the chip resistor having the three-layered structure depicted by $T_2$ in FIG. 3, e.g. using laser trimming means. Since the effective sectional area S2 of the resistor layer 3 to which trimming is applied is larger than that of the conventional chip resistor, the resistance value rather increases by low degrees for an area to be cut away by trimming. Accordingly, the adjustment of resistance value can be effected with high accuracy by finely adjusting the trimming amount.

Figure 4:
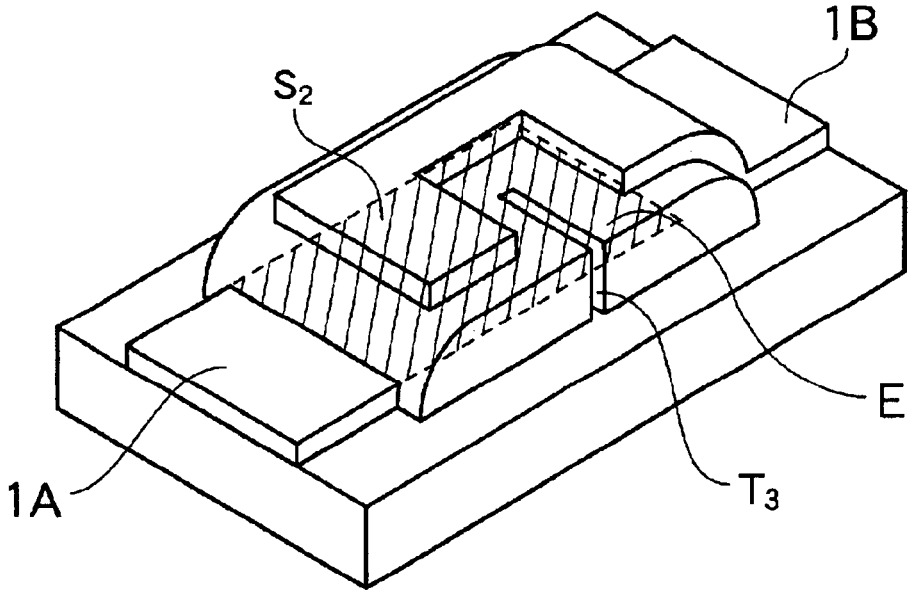
FIG. 4 is a perspective view showing another trimming state of the chip resistor.

FIG. 4 is a view for explaining a trimming method for adjusting a resistance value with more accuracy.

In the preferred embodiment, prior to trimming, the upper electrode, i.e. the second electrode 1B is cut in the range sufficiently wider than the width of the cut chip resistor $T_2$ in FIG. 3 (hereinafter referred to as trimming $T_2$) in the shape of the letter U, so that the resistor layer 3 is exposed corresponding to the U-shaped cut portion of the second electrode 1B, then a fine trimming $T_3$ is directly applied to the resistor layer 3 at the exposed portion E, thereby controlling the resistance value so as to accurately adjust the resistance value.

The method of forming the exposed portion E on resistor layer 3 through the second electrode 1B is arbitrary, and hence the exposed portion E may be formed as an electrode pattern from the beginning, or it may be formed by cutting away a part of the already fabricated electrode by an etching treatment and the like, so that the lower resistor layer 3 is exposed through the cut portion of the electrode.

Figure 5:
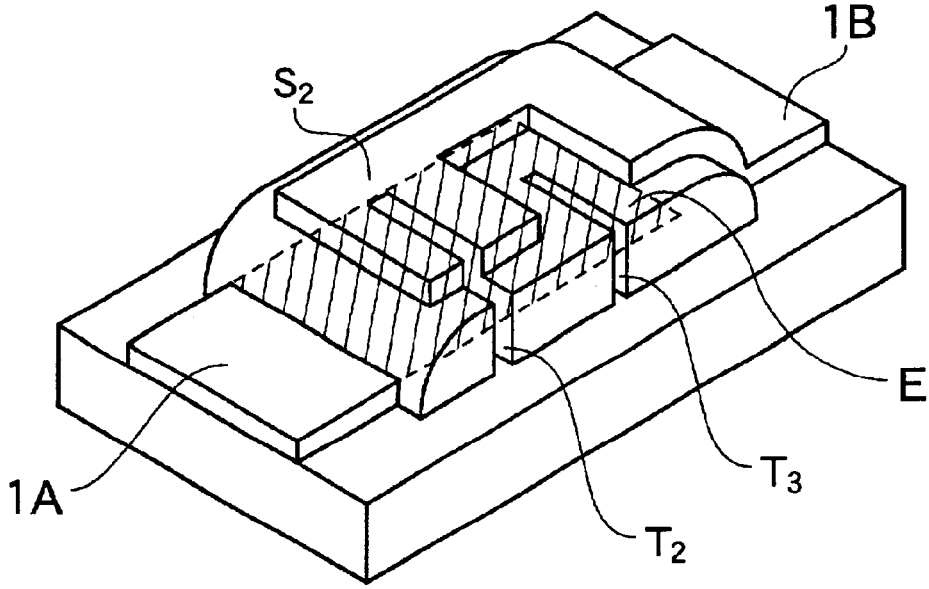
FIG. 5 is a perspective view showing still another trimming state of the chip resistor.

FIG. 5 is a view for explaining a trimming method when actually adjusting a resistance value of the chip resistor. This trimming method is a combination of the application of the trimming $T_2$ shown in FIG. 3 and the trimming $T_3$ shown in FIG. 4. That is, the trimming $T_2$ is applied to the resistor layer 3 by notching the resistor layer 3 from the upper portion of the first electrode 1A of the chip resistor 10A, thereby increasing the resistance value to a target resistance value to some extent, thereafter as shown in FIG. 4, a fine trimming $T_3$ is directly applied to the resistor layer 3 at the exposed portion E having a range sufficiently larger than a width of a normal trimming through the U-shaped cut portion of the second electrode 1B, thereby finely adjusting the resistance value.

According to the preferred embodiment, since the trimming step is effected before applying an overcoat treatment onto the resistor layer, the resistance value can be accurately corrected, and the trimmed portion of the resistor layer can be completely sealed by a subsequent overcoat treatment.

The resistor layer of the chip resistor which is adjusted in resistance value is subjected to an overcoat printing with black resin or glass material, then it is dried, subsequently, a mark of the chip resistor is printed on the printed overcoat which is then dried.

The thus fabricated multiple chip resistors formed in a matrix on the substrate are subjected to bar braking at portions of the respective electrodes of the respective chip resistors in a subsequent primary dividing step, namely, cut perpendicularly relative to a line connecting between the first and second electrodes, so that the multiple chip resistors are separated to form bar-like members which are arranged side by side in a vertical direction. In the subsequent step, paste for an electrode is printed on each side surface of the thus fabricated bar-like members and it is braked thereafter, thereby forming side surface electrodes of the respective chip resistors.

The bar-like members to which side surface electrodes are provided are subjected to a chip breaking, namely, they are separated into individual chip resistors in the subsequent secondary dividing step, wherein the electrode portions are nickel-plated or soldered in an electrolytic bath, thereby forming final chip resistor products. According to the preferred embodiment, the respective chip resistors are nickel-plated after they are individually separated so that the electrode portions are completely sealed by a nickel-plated film, thereby preventing migration of the solder and the electrodes from being exposed upon completion of soldering. Still further, solder plating is further applied onto the nickel-plated layer, thereby applying wettability of solder onto the electrode portions.

According to the chip resistor of the first and second aspects of the invention, since the sectional area of the chip resistor can be made larger than that of the conventional chip resistor, and the distance between both electrodes can be reduced so that a resistance value lower than that of the conventional chip resistor can be obtained, and also since the distance between the electrodes is small, a noise restriction or reduction effect can be expected and yet since the sectional area is made large and the distance between the electrodes is made small, an overvoltage breakage caused by the concentration current hardly occurs, thereby improving a voltage characteristic. Further, since the sectional area of the chip resistor according to the invention can be made larger than that of the conventional chip resistor when adjusting a resistance value, a ratio of change of a resistance value owing to the change of a sectional area caused by the application of trimming can be relatively made small, thereby adjusting the resistance value with higher accuracy compared with the conventional chip resistor.

According to the chip resistor of the third aspect of the invention, since the sectional area of the chip resistor can be made larger than the conventional chip resistor, the trimming is first applied to the resistor layer from the upper portion of the first electrode so as to approach the resistance value to a target value, then the trimming is directly applied to the resistor layer at an exposed portion corresponding to and through the U-shaped cut portion of the second electrode so that two steps of adjustment for accurately adjusting the resistance value can be effected, thereby obtaining a given resistance value with high accuracy

What is claimed is:

1. A chip resistor comprising:

a first surface electrode formed on an insulating substrate and serving as a first contact electrode;

a resistor layer formed on the first surface electrode;

a second surface electrode formed on the resistor layer and the insulating substrate and serving as a second contact electrode; and means for adjusting resistance value, said means comprising a cut to at least one of said first surface electrode and said substrate, wherein a portion of all of said first surface electrode, said second surface electrode and said resistor layer are overlapping on a portion of said insulating substrate.

2. A chip resistor comprising:

a first surface electrode formed on an insulating substrate;

a resistor layer formed on the first surface electrode;

a second surface electrode formed on the resistor layer and the insulating substrate; and resistance value adjusting means, wherein the resistance value adjusting means comprises a trimming section formed on the resistor layer by trimming the resistor layer through the second surface electrode to at least one of said first surface electrode and said substrate.

3. A chip resistor comprising:

a first surface electrode formed on an insulating substrate;

a resistor layer formed on the first surface electrode;

a second surface electrode formed on the resistor layer and the insulating substrate; and resistance value adjusting means, wherein the resistance value adjusting means comprises a first trimming section formed on the resistor layer by trimming the resistor layer through the second surface electrode to at least one of said first surface electrode and said substrate, and a second trimming section formed on the resistor layer by trimming the resistor layer at an exposed portion through a cut portion of the second surface electrode to at least one of said first surface electrode and said substrate.

4. A chip resistor according to claim 1, wherein the second surface electrode is formed on a substantial portion of the surface of the resistor layer and a portion of the insulating substrate.

5. A chip resistor comprising:

an insulating substrate having a planar surface;

a first surface electrode layer formed on said planar surface of said insulating substrate and serving as a first contact electrode;

a resistor layer formed on said first surface electrode layer;

a second surface electrode layer formed on the resistor layer and the insulating substrate and serving as a second electrode contact, wherein a portion of all of said first surface electrode layer, said resistor layer and said second surface electrode layer are overlapping in that order where said first surface layer is formed on a portion of said planar surface; and a trimming section comprising at least one selectively removed volume of said resistor layer to at least one of said first surface electrode and said substrate, and being operative to adjust the resistance value of the chip resistor.

6. A chip resistor according to claim 5, wherein the second surface electrode layer is formed on a portion of the surface of the resistor layer and a portion of the insulating substrate.

7. A chip resistor comprising:

an insulating substrate;

a first surface electrode layer formed on said insulating substrate;

a resistor layer formed on said first surface electrode layer;

a second surface electrode layer formed on the resistor layer and the insulating substrate; and a trimming section comprising at least one selectively removed volume of said resistor layer cut to at least one of said first surface electrode and said substrate and being operative to adjust the resistance value of the chip resistor, wherein the second surface electrode layer comprises an open surface area and said trimming section is disposed under the open surface area of the second surface electrode layer.

8. A chip resistor comprising:

an insulating substrate;

a first surface electrode layer formed on said insulating substrate;

a resistor layer formed on said first electrode layer;

a second surface electrode layer formed on the resistor layer and the insulating substrate; and a trimming section comprising at least one selectively removed volume of said resistor layer and being operative to adjust the resistance value of the chip resistor, wherein the second surface electrode layer comprises at least a first and a second open surface area separately formed on said second surface electrode layer, and said trimming section has a respective portion that is disposed under each open surface area of the second surface electrode layer formed by a cut to at least one of said first surface electrode and said substrate.

9. The chip resistor according to claim 7, wherein said open surface area comprises a pre-patterned area.

10. The chip resistor according to claim 7, wherein said open surface area comprises an etched area.

11. The chip resistor according to claim 7, wherein said open surface area comprises a cut area.

* * * * *